US006742690B2

(12) United States Patent
Gerulski et al.

(10) Patent No.: US 6,742,690 B2
(45) Date of Patent: Jun. 1, 2004

(54) WOUND FILM DISPENSER WITH INTERIOR RETAINERS AND METHOD FOR MANUFACTURING SAME

(75) Inventors: Kristopher W. Gerulski, Racine, WI (US); Alan John Linder, Waukesha, WI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 0 days.

(21) Appl. No.: 09/993,274

(22) Filed: Nov. 16, 2001

(65) Prior Publication Data

US 2002/0117529 A1 Aug. 29, 2002

Related U.S. Application Data

(63) Continuation-in-part of application No. 09/711,017, filed on Nov. 13, 2000, now Pat. No. 6,564,942.

(51) Int. Cl.[7] ..... B65D 85/672
(52) U.S. Cl. ..... 225/47; 206/396
(58) Field of Search ..... 206/396, 408, 206/397; 225/46, 47; 09/433

(56) References Cited

U.S. PATENT DOCUMENTS

| | | | | |
|---|---|---|---|---|
| 1,076,635 | A | | 10/1913 | Howard |
| 1,082,964 | A | | 12/1913 | Macdonald |
| 1,691,995 | A | | 11/1928 | Saulter |
| 1,889,933 | A | * | 12/1932 | Pratt ..... 206/396 |
| 1,907,922 | A | | 5/1933 | Wllis |
| 2,330,117 | A | | 9/1943 | Feinberg et al. |
| 2,458,844 | A | | 1/1949 | Foote |
| 2,472,521 | A | | 6/1949 | Danenbauer |
| 2,507,403 | A | | 5/1950 | Gluck |
| 2,624,521 | A | | 1/1953 | Broeren |
| 2,743,009 | A | | 4/1956 | Williamson et al. |
| 2,748,931 | A | | 6/1956 | Taylor |
| 2,799,393 | A | | 7/1957 | Klein |
| 2,803,339 | A | | 8/1957 | Kuchenbecker |
| 2,853,185 | A | | 9/1958 | Rollie |
| 2,860,773 | A | * | 11/1958 | Zackheim ..... 206/394 |
| 2,864,493 | A | | 12/1958 | Holcombe |
| 2,935,192 | A | * | 5/1960 | Million-Czarnecki ..... 206/396 |
| 3,121,542 | A | | 2/1964 | Van Dyke et al. |
| 3,128,025 | A | | 4/1964 | Buttery et al. |
| 3,159,323 | A | | 12/1964 | Hawk |
| 3,166,187 | A | | 1/1965 | Araujo |
| 3,228,519 | A | | 1/1966 | Dong, et al. |
| 3,229,812 | A | * | 1/1966 | Metzger ..... 206/396 |
| 3,246,742 | A | | 4/1966 | Coe |
| 3,262,620 | A | | 7/1966 | Burt et al. |
| 3,458,109 | A | | 7/1969 | Compton et al. |
| 3,477,624 | A | | 11/1969 | Branyon et al. |
| 3,530,980 | A | | 9/1970 | Link |
| 3,587,840 | A | | 6/1971 | Hultberg |
| 3,613,973 | A | | 10/1971 | Jaeschke |

(List continued on next page.)

FOREIGN PATENT DOCUMENTS

WO WO 03/106121 A1 12/2003

*Primary Examiner*—Kenneth E. Peterson

(57) ABSTRACT

A dispenser for rolls of wound film is disclosed, as well as a method of manufacturing such a dispenser. The dispenser includes a trunk to which a lid is hingedly attached. First and second end walls of the trunk include retainers adapted to penetrate into hollow ends of a roll of wound film disposed within the trunk. The first and second retainers include multiple flaps which are locked into a penetrating position. The multiple flaps may include first and second parallel wing flaps which are pushed inwardly by a locking flap. The combined flaps may be locked into position by frictional engagement of the locking flap in notches provided in the first and second wing flaps. By penetrating the first and second ends of the roll, the roll is reliably held within the trunk, and less susceptible to being inadvertently pulled from the carton during dispensing of the film.

9 Claims, 4 Drawing Sheets

U.S. PATENT DOCUMENTS

| | | | | | |
|---|---|---|---|---|---|
| 3,685,644 | A | | 8/1972 | Cothran et al. | |
| 3,698,548 | A | | 10/1972 | Stenzel et al. | |
| D232,081 | S | | 7/1974 | Zine Jr. | |
| 4,062,447 | A | | 12/1977 | Gardner | |
| 4,151,914 | A | | 5/1979 | Blatt | |
| 4,159,768 | A | * | 7/1979 | Manis et al. | 206/396 |
| 4,238,065 | A | | 12/1980 | Ragsdale | |
| 4,298,123 | A | | 11/1981 | Roccaforte et al. | |
| D267,544 | S | | 1/1983 | Neto et al. | |
| 4,373,687 | A | | 2/1983 | Zicko | |
| 4,401,217 | A | * | 8/1983 | Blatt | 206/408 |
| 4,667,824 | A | | 5/1987 | Ditchfield | |
| 4,715,519 | A | | 12/1987 | Fischer | |
| 4,813,539 | A | | 3/1989 | Church et al. | |
| 4,817,796 | A | * | 4/1989 | Camillo et al. | 206/396 |
| 4,925,028 | A | | 5/1990 | Smith | |
| D313,752 | S | | 1/1991 | Dyble | |
| 4,998,656 | A | | 3/1991 | Hurh | |
| D325,311 | S | | 4/1992 | Mygind | |
| 5,121,839 | A | | 6/1992 | Lapp | |
| 5,141,108 | A | | 8/1992 | Roccaforte | |
| 5,150,789 | A | * | 9/1992 | Bass | 206/396 |
| 5,449,070 | A | | 9/1995 | Broderick | |
| 5,484,082 | A | | 1/1996 | Casper et al. | |
| 5,511,663 | A | | 4/1996 | Shimura et al. | |
| 5,533,620 | A | * | 7/1996 | Torterolo | 206/408 |
| D372,387 | S | | 8/1996 | Kuchenbecker | |
| 5,642,812 | A | * | 7/1997 | Hale | 206/396 |
| D383,934 | S | | 9/1997 | McNaughton | |
| 5,662,758 | A | | 9/1997 | Hamilton et al. | |
| D395,823 | S | | 7/1998 | Durand | |
| 5,871,607 | A | | 2/1999 | Hamilton et al. | |
| 5,893,458 | A | * | 4/1999 | Sisk | 206/396 |
| D414,061 | S | | 9/1999 | Peachey | |
| 5,971,150 | A | | 10/1999 | Anderson et al. | |
| 6,612,473 | B1 | | 9/2003 | Newby et al. | |

* cited by examiner

WOUND FILM DISPENSER WITH INTERIOR RETAINERS AND METHOD FOR MANUFACTURING SAME

CROSS-REFERENCE TO RELATED APPLICATION

This application is a continuation-in-part of U.S. patent application Ser. No. 09/711,017, filed on Nov. 13, 2000, now U.S. Pat. No. 6,564,942.

FIELD OF THE INVENTION

The invention generally relates to dispensers and, more particularly, relates to dispensers for use in conjunction with wound films such as plastic wrap, aluminum foil, wax paper, and the like.

BACKGROUND OF THE INVENTION

Cartons for the storage and dispersal of rolls of wound flexible film are well-known. Such cartons are typically manufactured from paperboard material and are folded into a configuration conventionally referred to as a trunk-lid box wherein a base or box of the carton forms an enclosure for the roll with an open top, and the lid is folded relative to the trunk at a natural hinge to thereby allow the lid to close the trunk.

A number of criteria need to be considered when manufacturing such a carton. One concern is the ease with which the material can be drawn from the roll. This criteria is a function of a number of variables including the type of material wound onto the roll, the manner in which the roll is positioned or placed within the carton, and the angle at which the material must be pulled from the carton. For example, if the material is of a highly adhesive nature, it may tend to adhere to itself thereby requiring a relatively high level of force to pull the material from the roll. Depending upon the degree of tack of the film, and the angle at which the material is pulled from the carton, the roll itself may tend to be pulled completely out of the carton, creating a source of frustration for the user. Morever, once the roll is pulled from the carton, the risk of contamination of the film is increased.

Mechanisms have therefore been devised which perform a retention feature within the carton. In other words, the roll itself may be physically held within the carton such that upon a user pulling on the film, the roll is held against the force created by the user, while still enabling the roll to rotate and thereby dispense film. For example, U.S. Pat. No. 4,998,656, assigned to the present assignee, discloses a roll restraining dispensing carton wherein the opposite ends of the carton include collars for retaining the roll within the carton. The collars include apertures which circumnavigate the ends of the roll to thereby physically hold the roll within the carton, and also provide a bearing surface around which the roll may rotate.

While such cartons have proven to be successful, it would be advantageous to continue to improve roll retention and dispensing capabilities. Moreover, since such cartons are typically manufactured and loaded with rolls of wound film in an automated process. It would be advantageous to improve the ease with which the carton is manufactured as well.

SUMMARY OF THE INVENTION

In accordance with one aspect of the invention, a dispenser for rolls of wound film is provided, wherein the roll includes a core having first and second hollow ends with film being wound around the core. A dispenser includes a trunk defining an interior channel, a lid hinged to the trunk, and first and second retainers connected to the trunk and extending into the interior channel. The first and second retainers are adapted to penetrate the first and second hollow ends of the core.

In accordance with another aspect of the invention, a method of assembling a wound film dispenser is provided comprising the steps of folding a pre-formed blank into a tube having first and second open ends, inserting a roll of wound film into the tube through one of the first and second open ends, folding retainer plies into the first and second open ends, folding a major flap against each of the retainer plies, and pushing a locking flap inward through one of the retainer plies. The retainer plies each include first and second retainer flaps hinged thereto. Each major flap includes a locking flap hinged thereto. Each locking flap is frictionally engaged with the retainer flaps of one of the retainer plies. The locking flaps and retainer flaps penetrate the first and second hollow ends of the roll.

In accordance with another aspect of the invention, a wound film dispenser is provided which comprises a trunk, a lid, a roll of wound film, a first retainer, and a second retainer. The trunk includes a bottom wall, a back wall, a front wall, a first end wall, a second end wall, and an open top. The lid is hinged to the trunk adjacent to the trunk back wall and includes a top wall, a front wall, a first end wall, and a second end wall. The roll of wound film is disposed within the trunk and includes an axle around which a web of film is wound, as well as first and second hollow ends. A first retainer extends from the trunk first end wall into the axle first hollow end, while the second retainer extends from the trunk second end wall and into the axle second hollow end. Each of the first and second retainers includes first and second flaps locked in position by a third flap.

These and other aspects and features of the invention will become more apparent upon reading the following detailed description when taken in conjunction with the accompanying drawings.

Figure 1:
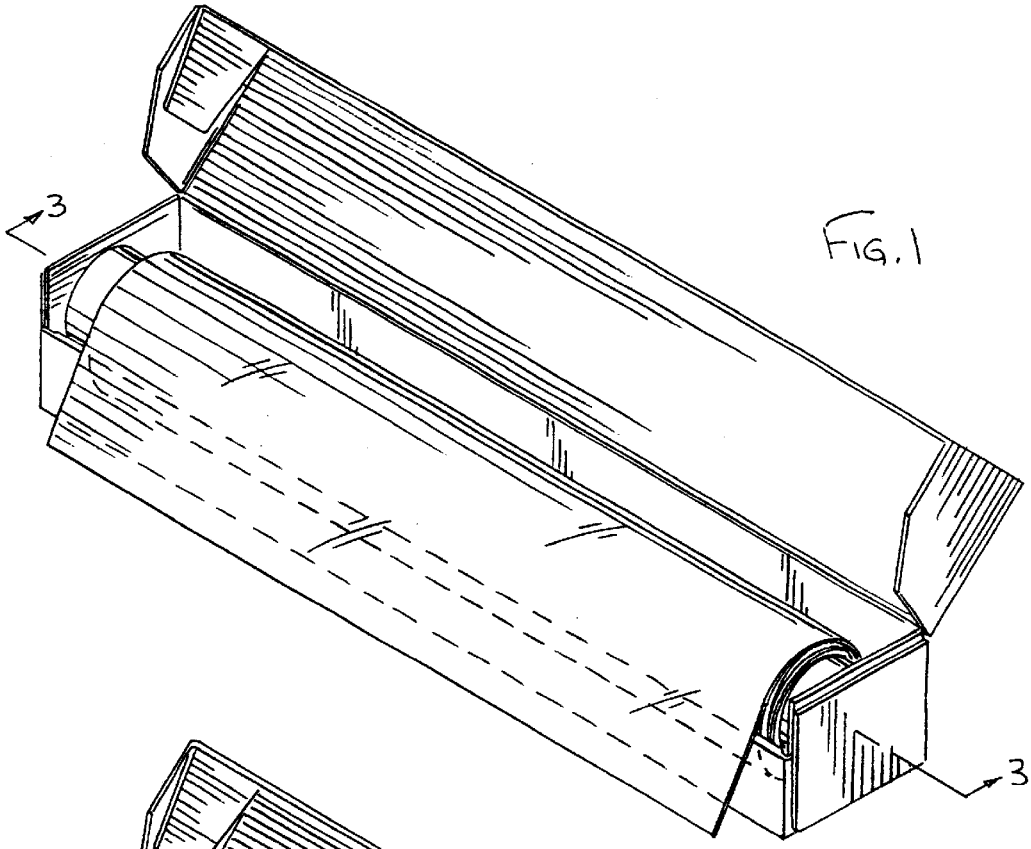
FIG. 1 is an isometric view of a wound film dispenser constructed in accordance with the teachings of the invention, and with a roll of wound film held therein.

While the invention is susceptible to various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention as defined by the appended claims.

DETAILED DESCRIPTION OF THE PREFERRED EMBODIMENTS

Referring now to the drawings, and with specific reference to FIG. 1, a film dispenser or carton constructed in accordance with the teachings of the invention is generally referred to by reference numeral 20. As shown therein, the film dispenser 20 is adapted to house and dispense film material such as plastic wrap, aluminum foil, wax paper, and the like.

The carton 20 includes a base 22 to which is hinged a lid 24. Film 26 is wound upon a roll 28 and positioned within an enclosure 29 defined by the base 22. The base 22 includes, as shown best in FIG. 2, a bottom wall 30, a back wall 32, a front wall 34, a first end wall 36, and a second end wall 38. The lid 24 includes a top wall 40, a front wall 42, a first end wall 44, and a second end wall 46. A cutter bar 48 (FIG. 4) is adhered to an inside surface 50 of the lid front wall 42. A tear strip 52 is provided adjacent the front wall 42 with a score line 53 being therebetween. Adhesive is provided between the tear strip 52 and the base front wall 34 for securing the tear strip 52 until the time of use. A cutter bar 58 includes a plurality of teeth 60 which are exposed below the lid front wall 42 when the tear strip 52 is removed.

Figure 3:
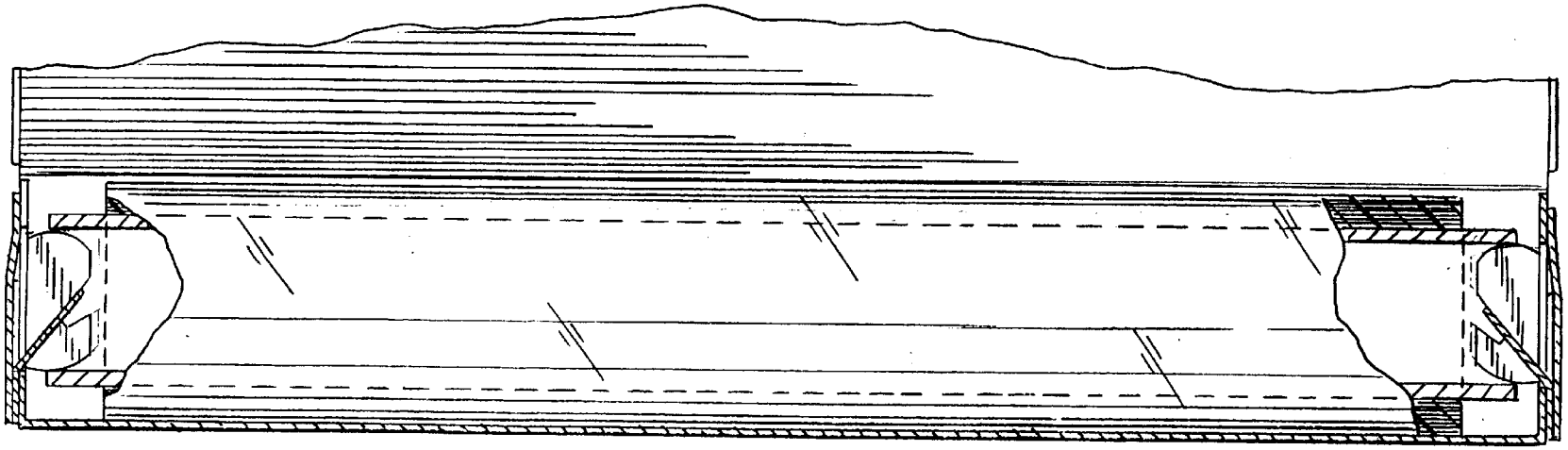
FIG. 3 is a longitudinal sectional view of the film dispenser of FIG. 2 taken along line 3—3 of FIG. 1.

The roll 28, as shown best in FIG. 3, includes a cylindrical outer surface 62 having first and second open ends 64, 66. The roll 28 is preferably manufactured from paperboard, fiberboard, cardboard, or the like, but may be formed of other suitable materials such as plastic. The film 26 provided thereon may be of the same or lesser width than the roll 28.

Figure 2:
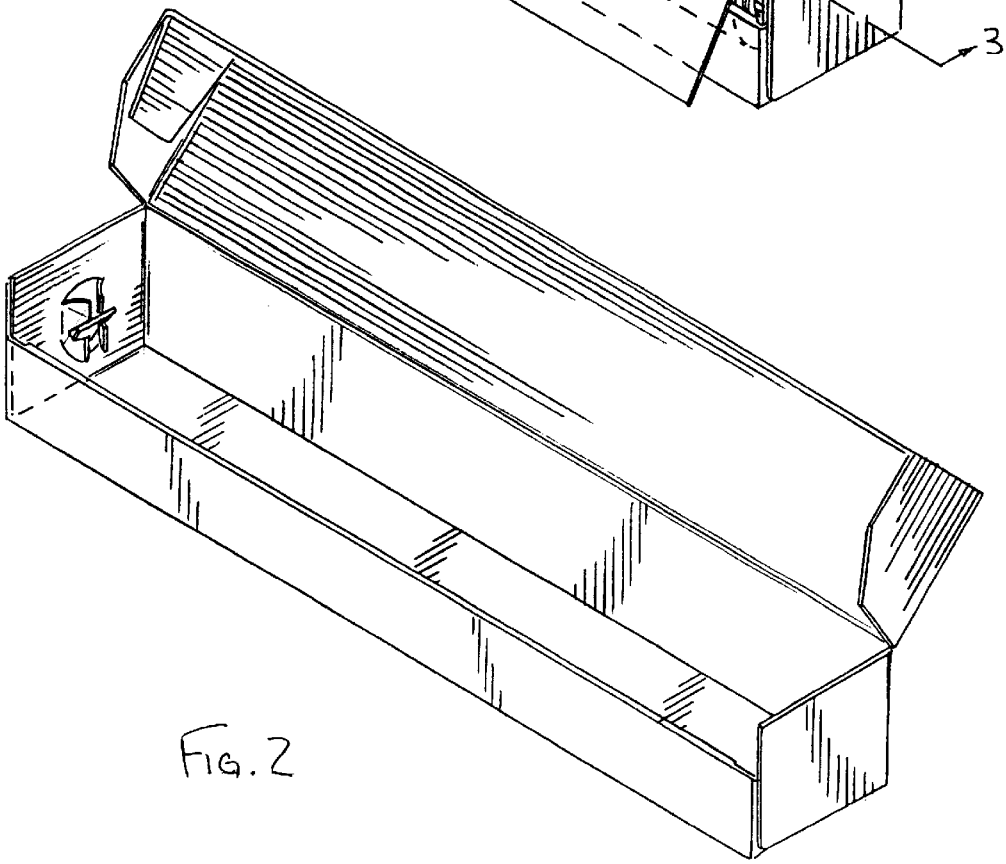
FIG. 2 is an isometric view of the wound film dispenser of FIG. 1, but without a roll of wound film disposed therein.

The first and second end walls 36, 38 of the base 22 include retainers 68 as shown in FIGS. 2 and 3. Each retainer 68 extends laterally into the enclosure 29 and into one of the first and second open ends 64, 66 of the roll 28 to retain the roll 28 securely within the dispenser 20 and yet enable the roll 28 to freely rotate to facilitate dispensing of the film 26.

In the depicted embodiment, each retainer includes first and second hinge flaps 70, 72, and a locking flap 74. As shown best in FIG. 4, each hinge flap 70, 72 includes a pivot edge 76, a top edge 78, a bottom edge 80, and a side edge 82. A locking notch 84 is provided in each side edge 82. Each pivot edge 76 is depicted in a vertical disposition parallel to the front and back walls 34, 32, but it is to be understood that in alternative embodiments the pivot edges 76 and hinge flaps 70, 72 may be provided at any other rotational position. Each locking flap 74 includes a pivot edge 85, first and second side edges 86, 88, and a top edge 89. Each side edge 86, 88 is adapted to be frictionally received within notches 84.

It is to be understood that if the hinge flaps 70, 72 are alternatively disposed in a non-vertical orientation, the locking flap 74 will be correspondingly moved to ensure engagement with the hinge flaps 70, 72.

When the locking flaps 74 are pushed laterally into the enclosure 29 and locked into engagement with the hinge flaps 70, 72, the top edges 78 and bottom edges 80 of each hinge flap 70, 72 form bearing surfaces adapted to engage an interior surface 90 of the roll 28 as shown best in FIG. 3. Such bearing surfaces facilitate rotation of the roll 28 when the film 26 is pulled therefrom. In alternative embodiments, each retainer 68 may include only one, or more than two, hinge flaps.

Figure 5:
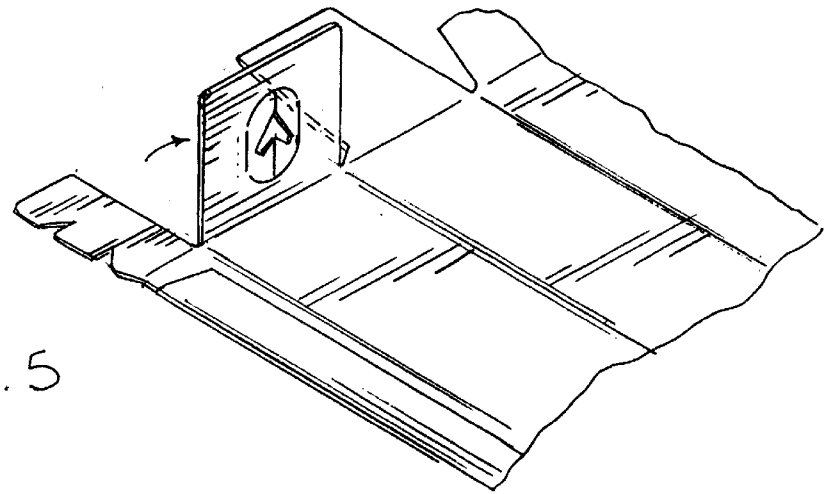
FIG. 5 is a cut-away isometric view of a film dispenser being constructed in accordance with the teachings of the invention at a first stage of assembly.
Figure 4:
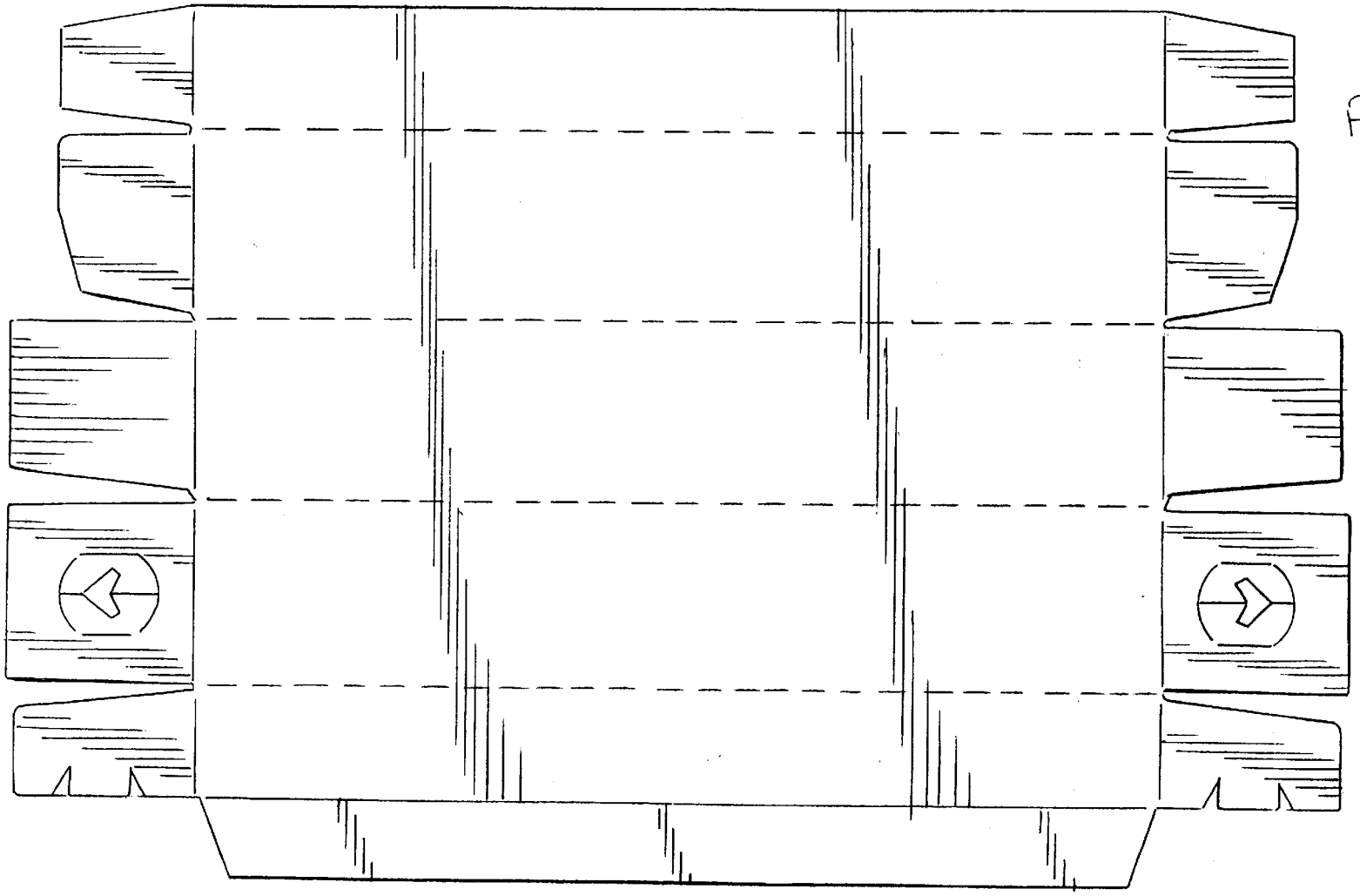
FIG. 4 is a plan view of a die-cut blank prior to folding according to the teachings of the invention.

In the depicted embodiment each of the first and second base end walls 36, 38 is formed from an interior flap 92, a minor flap 94, and a major flap 96. The interior flap 92 may be hinged to the base bottom wall 30, the minor flap 94 may be hinged to the base front wall 34, and the major flap 96 may be hinged to the base back wall 32. As shown in FIGS. 4 and 5, the first and second hinge flaps 70, 72 may be formed in the interior flap 72, while the locking flap 74 may be formed in the minor flap 94.

The end walls 44 and 46 of the lid 24 may also be formed by individual flaps folded and adhered together. Each may be formed by a major flap 98 extending from the lid top wall 40, and a minor flap 100 extending from the lid front wall 42.

In forming the dispenser 20, a blank 102 such as that depicted in FIG. 4 is typically die-cut from a sheet of paperboard stock. The blank 102 may be alternatively fabricated as by shearing, sawing, cutting and the like, and may be formed of other materials including such cellulosic articles as fiberboard, microboard, cardboard, and the like.

Once the blank 102 is formed, a series of folding steps are undertaken to assemble the dispenser 20. While the first step is typically to fold the blank 102 into a tube having first and second open ends, for the purpose of illustration, the end walls of the carton are depicted in FIGS. 5–8 as being assembled first. It is to be understood that such figures are provided simply for ease of illustration, and that in the preferred embodiment, the blank 102 is folded into a tube, the tear strip 52 is adhered to the base of the front wall 34, the roll 26 is inserted through one of the open ends of the tube, and the end walls are then assembled as will be discussed in further detail below.

Figure 6:
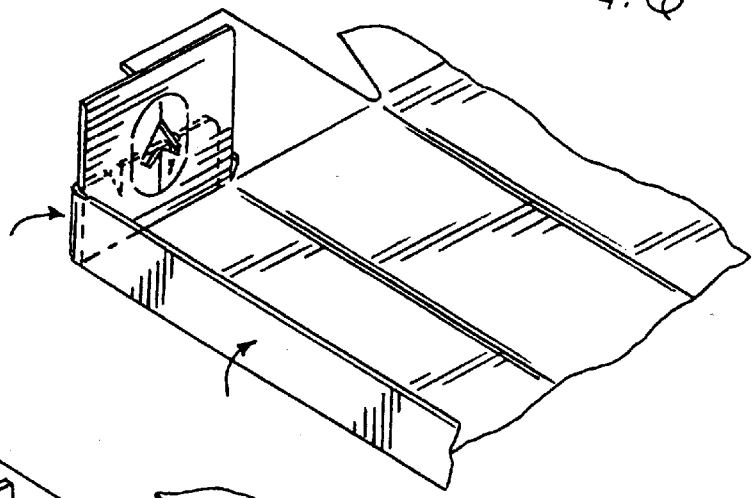
FIG. 6 is a cut-away isometric view of a film dispenser being constructed in accordance with the teachings of the invention at a second stage of assembly.
Figure 7:
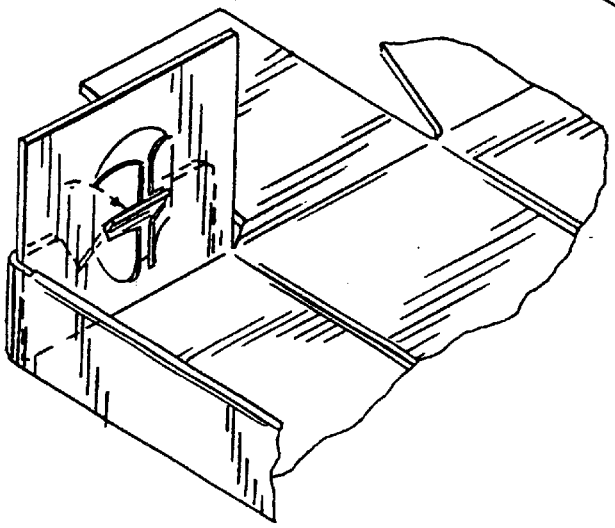
FIG. 7 is a cut away isometric view of a film dispenser being constructed in accordance with the teachings of the invention at a third stage of assembly.

Referring to FIG. 5, it will be noted that interior flaps 92 are first folded upwardly. The minor flaps 94, as shown in FIG. 6, are then folded back so as to be parallel to the interior flaps 92. The locking flaps 74 are then pushed into the enclosure 29 as shown in FIG. 7, about pivot edge 85. In so doing, the locking flaps 74 push the hinge flaps 70, 72 inwardly as well. The locking flap 74 is pushed until the side edges 86, 88 of each are received within the notches 84 of the hinge flaps 70, 72. The retainers 68 are thereby fully formed to not only hold the roll 28 within the dispenser 28, but also form bearing surfaces about which the roll 28 may rotate.

Figure 8:
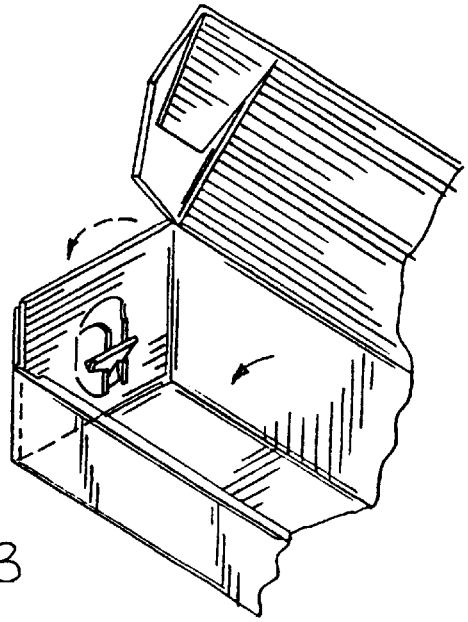
FIG. 8 is a cut away isometric view of a film dispenser being constructed in accordance with the teachings of the invention at a fourth stage of assembly.

The major flaps 96 are then folded forward so as to be parallel to the minor flaps 94 and adhered thereto, as indicated in FIG. 8. In so doing, the enclosure 29 is substantially closed from air borne contaminants, thereby protecting the sanitary nature and efficacy of the film 26. To complete the dispenser 20, the major flap 98 and minor flap 100 of the lid 24 are then folded inwardly and adhered into parallel positions as shown in FIGS. 1 and 2.

One of ordinary skill in the art will readily appreciate that the teachings of the invention may be employed to construct film dispensers with enhanced retention capability and improved manufacturability.

What is claimed is:

1. A dispenser for rolls of wound film, including a core having first and second hollow ends with film being wound around the core, the dispenser comprising:

a trunk defining an interior channel;

a lid hinge to the trunk; and first and second retainers connected to the trunk and extending into the interior channel, each retainer including first and second flaps having notches hinged to the trunk and sized to be received in one of the first and second hollow ends of the core, wherein each retainer includes a lock adapted to hold the first and second flaps in the retainer position, and wherein the lock is a third flap hinged to the trunk and sized to be frictionally held within the notches of the first and second flaps, wherein the trunk includes first and second end walls, each of the first and second end walls including a retainer ply hinged to a base of the trunk, a minor flap hinged to a front wall of the trunk, and a major flap hinged to a back wall of the trunk, the first and second flaps hinged to the retainer ply, and the third flap hinged to the minor flap.

2. The dispenser of claim 1, wherein the trunk, lid, first retainer, and second retainer are formed from an integral piece of material.

3. The dispenser of claim 2, wherein the material is twenty-four point chipboard.

4. The dispenser of claim 2, wherein the material is chipboard with a point count of less than twenty four.

5. The dispenser of claim 1, further including a cutter bar adhered to an inside surface of the lid.

6. The dispenser of claim 5, wherein the cutter bar is made of polyethylene.

7. The dispenser of claim 5, wherein the cutter bar is made of metal.

8. A wound film dispenser, comprising;

a trunk having a bottom wall, back wall, front wall, first end wall, second end wall, and an open top;

a lid hinged to the trunk adjacent to the trunk back wall, the lid including a top wall, front wall, a first end wall, and a second end wall;

a roll of wound film disposed within the trunk, the roll including an axle upon which a web of film is wound, the axle including first and second hollow ends;

a first retainer extending from the trunk first end wall into the axle first hollow end;

a second retainer extending from the trunk second wall into the axle second hollow end; and each of the first and second containers including first and second flaps locked in position by a third flap wherein each of the first and second flaps include notches frictionally engaging sides of the third flaps, wherein each of the trunk end walls includes first, second, and third plies, each first ply including one of the first retainer flaps and one of the second retainer flaps, each of the second plies including one of the third retainer flaps.

9. The wound film dispenser of claim 8, wherein each of the first plies is hinged to the trunk bottom wall, each of the second plies is hinged to the trunk front wall, and each of the third plies is hinged to the trunk back wall.

* * * * *